US006326927B1

(12) United States Patent
Johnson et al.

(10) Patent No.: US 6,326,927 B1
(45) Date of Patent: Dec. 4, 2001

(54) CAPACITIVELY-TUNED BROADBAND ANTENNA STRUCTURE

(75) Inventors: Greg Johnson, Aptos; Robert Hill, Salinas, both of CA (US); Don Keilen, Sparks, NV (US)

(73) Assignee: Range Star Wireless, Inc., Aptos, CA (US)

( * ) Notice: Subject to any disclaimer, the term of this patent is extended or adjusted under 35 U.S.C. 154(b) by 0 days.

(21) Appl. No.: 09/620,793

(22) Filed: Jul. 21, 2000

Related U.S. Application Data

(60) Provisional application No. 60/144,907, filed on Jul. 21, 1999.

(51) Int. Cl.[7] ..... H01Q 1/24
(52) U.S. Cl. ..... 343/702; 343/700 MS
(58) Field of Search ..... 343/700 MS, 702, 343/846, 848

(56) References Cited

U.S. PATENT DOCUMENTS

| | | | | |
|---|---|---|---|---|
| 4,443,802 | | 4/1984 | Mayes | 343/729 |
| 4,980,694 | | 12/1990 | Hines | 343/702 |
| 5,041,838 | | 8/1991 | Liimatainen et al. | 343/700 |
| 5,124,733 | * | 6/1992 | Haneishi | 343/700 MS |
| 5,537,123 | | 7/1996 | Mandai et al. | 343/700 |
| 5,585,810 | | 12/1996 | Tsuru et al. | 343/749 |
| 5,757,333 | | 5/1998 | Kitchener | 343/826 |
| 5,764,190 | * | 6/1998 | Murch et al. | 343/702 |
| 5,767,810 | * | 6/1998 | Hagiwara et al. | 343/700 MS |
| 5,872,544 | | 2/1999 | Schay | 343/727 |
| 5,912,647 | | 6/1999 | Tsuru et al. | 343/700 |
| 5,917,450 | | 6/1999 | Tsunekawa | 343/700 |
| 5,940,041 | | 8/1999 | Koyama et al. | 343/702 |
| 5,969,680 | | 10/1999 | Tsuru et al. | 343/700 |
| 6,002,367 | * | 12/1999 | Engblom et al. | 343/700 MS |
| 6,008,764 | * | 12/1999 | Ollikainen et al. | 343/700 MS |

* cited by examiner

*Primary Examiner*—Hoanganh Le
*Assistant Examiner*—Hoang Nguyen
(74) *Attorney, Agent, or Firm*—Larkin Hoffman Daly & Lindgren, Ltd.; John F. Klas

(57) ABSTRACT

An antenna assembly for a wireless communication device for receiving and transmitting a communication signal is disclosed. The wireless communication device having a ground plane element and a feedline conductor, said antenna assembly including a configured radiating conductor element having a pair of opposed ends disposed proximate the ground plane element and an intermediate extending portion disposed away from the ground plane element to define an interior region, said first end operatively coupled to the ground plane element, said second end capacitively coupled to the ground plane element, and said intermediate extending portion operatively coupled to the feedline conductor at a feedpoint between the first end and the second end.

28 Claims, 6 Drawing Sheets

CAPACITIVELY-TUNED BROADBAND ANTENNA STRUCTURE

CROSS REFERENCE TO RELATED APPLICATION

This application claims the benefit of priority pursuant to 35 USC §119(e)(1) from the provisional patent application filed pursuant to 35 USC §111(b): as Ser. No. 60/144,907 on Jul. 21, 1999.

FIELD OF THE INVENTION

This invention relates generally to a compact antenna structure, and in particular to an antenna structure which is suitably utilized with a wireless communication device.

BACKGROUND OF IN THE INVENTION

Many wireless transceivers, and hand-held cell phones in particular, currently use external whip antennas that radiate nominally omnidirectionally. Little or no reduction is provided in transmitted RF energy that is directed toward the user's head. As a result, typical specific absorption rate (SAR) values of 2.7 mw/g at 0.5 watts input are realized. Additionally, the external assembly of a whip antenna can be relatively massive (weighing 8–9 grams) and may be subject to damage during use. The gain performance characteristic of the whip antenna is typically in the range −5 to +1.5 dBi. High-speed manufacturing and assembly techniques of wireless communication devices are typically not practicable with whip antennas, as such antennas typically require manual assembly and installation.

Also known are patch-type antennas. Known limitations of patch antennas include their relatively large size (approximately 4–10 times larger in volume than the current invention) required to provide a necessary operating bandwidth. Substantially large ground planes are also required with patch antennas to achieve the same front-to-back ratio as the current invention. Large ground planes are not practicable for use in today's hand-held wireless communication devices.

SUMMARY OF THE INVENTION

The present invention provides a compact antenna system having improved gain and front-to-back ratio. The antenna assembly according to the present invention may provide linear polarization and is suitable for use in wireless communications devices such as cellphones, PDA's, etc. The antenna assembly, when combined with a hand-held wireless transceiver, provides a far-field front-to-back ratio of 4 dB nominal, a specific absorption rate (SAR) on the order of 1.6 mw/g nominal on the rear side (toward the device user) with 0.5 watts power input to the antenna, and forward gain (away from the user's head) of +1.5 dB nominal. Relative size of the antenna is compatible with current wireless communication devices such that it may be easily integrated into or within the top rear portion of a wireless device.

The antenna may be characterized as a shorted, capacitively-tuned ⅛-wavelength broadband patch antenna. However, it provides substantial reduction in size over conventional ¼ or ½ wavelength patch antennas with similar operating bandwidths and front-to-back ratios. Additionally, signal polarization may be predetermined by choice of feedpoint, with linear or circular polarizations possible.

An object of the present invention is to provide an antenna that is capable of being surface-mounting to a transceiver dielectric substrate, such as its PWB (printed wiring board), in a high-volume production setting. Yet another object of the present invention provides an antenna that is capable of being placed away from and partially encompassing other components upon a transceiver PWB. The antenna defines an interior region between the radiator and the dielectric substrate within which other component of the wireless device may be disposed.

Another object of the present invention is to provide an antenna having a 3 dB beamwidth of between 110–160 degrees, as compared to a value of approximately 80 degrees of known dipole antenna devices. Additionally, an object of the present invention is to provide an antenna assembly having an operating bandwidth (2:1 VSWR) of 8% nominal over cellular telephone and PCS frequency ranges of 824–894 MHz and 1750–1990 MHz, respectively.

Another object of the invention is an antenna assembly that provides an improved specific absorption rate, and enhanced performance characteristics, such as gain, and front to back ratio.

Still another object of the invention is to provide an antenna assembly which may be incorporated within the wireless device housing.

These and other objects of the present invention will be apparent to those skilled in the relevant arts.

DESCRIPTION OF THE DRAWINGS

The accompanying drawings, which are incorporated in and form a part of this specification, illustrate preferred embodiments of the invention. In the drawings.

DESCRIPTIONS OF PREFERRED EMBODIMENTS OF THE INVENTION

Figure 1:
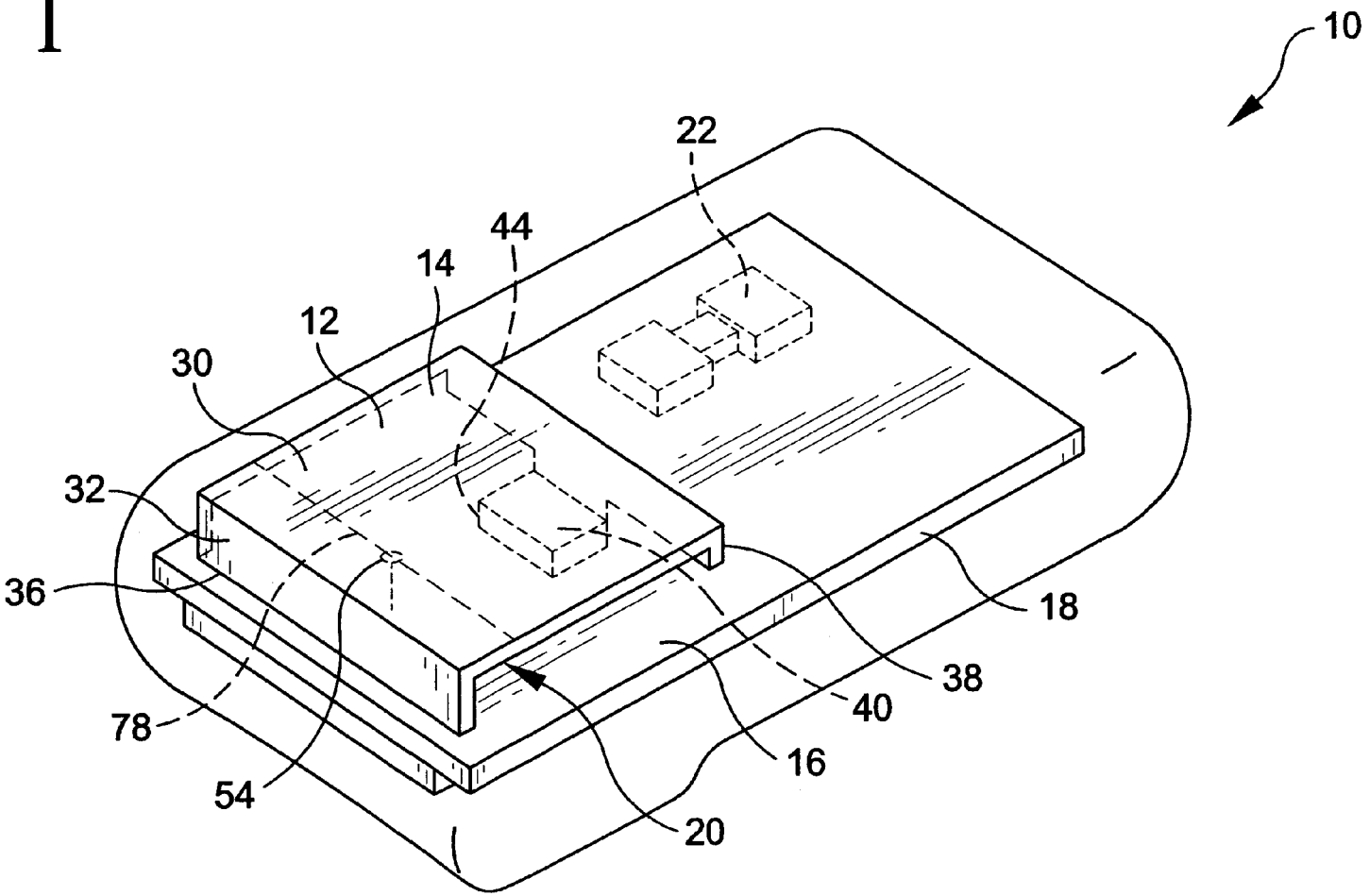
FIG. 1 illustrates a perspective view of wireless communication device incorporating an assembly according to the present invention.

FIG. 1. is a perspective view showing the internal structure of a wireless communication device 10, such as a cellular phone, including the antenna assembly 12 according to the present invention. It should be appreciated that the antenna assembly 12 of this invention is suitable for use with other wireless communication devices 10 such as hand-held radios, and other portable wireless communication devices that emit electromagnetic radiation.

Figure 2:
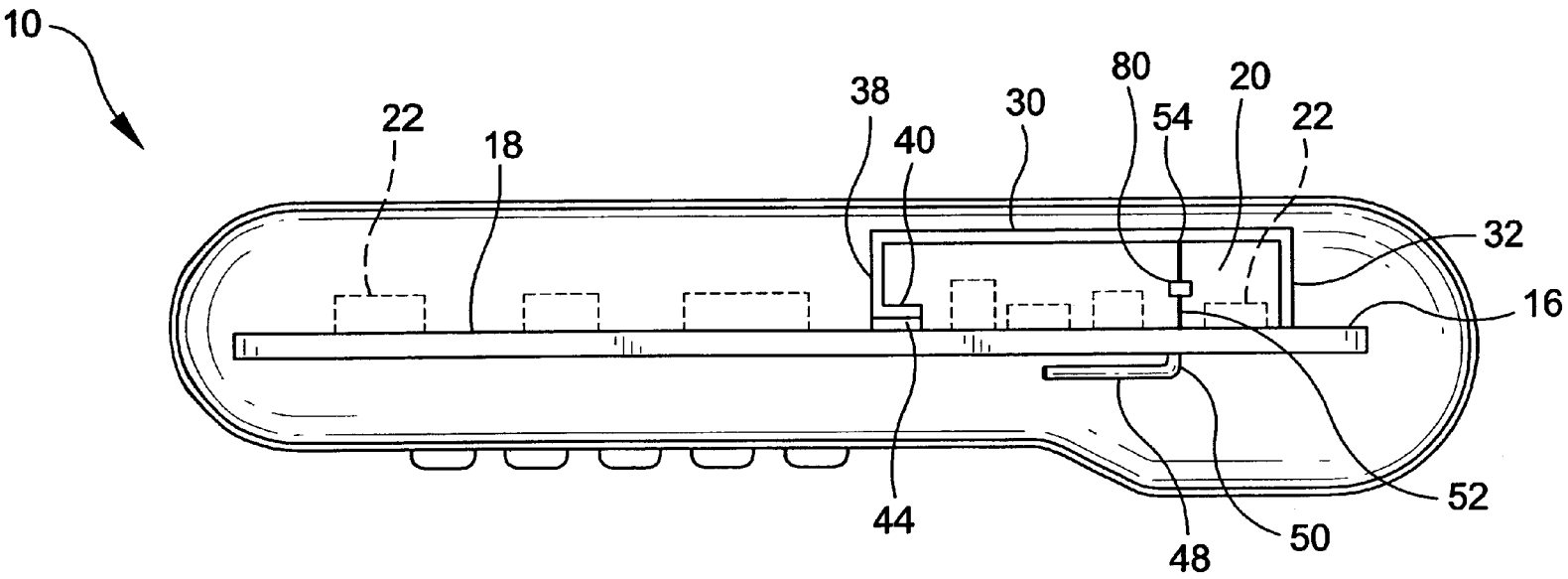
FIG. 2 illustrates a side elevational view of the wireless communication device of FIG. 1 incorporating the antenna assembly according to the present invention.

FIGS. 1 and 2 show an antenna assembly 12 embodying the present invention for operation over the 824–894 MHz frequency range. Alternative frequency range operations would be appreciated by those skilled in the arts. Performance characteristics may be affected by changes of the physical sizes and dimensions of the antenna assembly 12 component geometry. Such changes, alterations, or modifications may be made by those skilled in the relevant arts, though not departing from the scope of the invention disclosed herein.

The antenna assembly 12 includes a radiating conductor element 14 disposed relative to a dielectric substrate element 16 defining a ground plane trace or substrate 18. The dielectric substrate 16 may be defined by the printed wiring board PWB of the wireless communication device 10. The radiating conductor element 14 includes a plurality of surfaces, though it may be formed as a single formed metallic element. The radiating conductor 14 element is approximately 'C'-shaped and includes an interior region 20 disposed between the conductor 14 and the ground plane element 18. As illustrated in FIG. 2, device electronics 22 may be disposed within the interior region 20 of the radiating conductor 14 to achieve a compact device.

A first planar conduction surface 30 is disposed a predetermined distance above the conducting ground plane 18 (approximately 0.30 inch), and is electrically connected to a substantially perpendicular second conducting surface 32. The second conductive surface 32 is shorted to the ground plane 18 at an edge 36. The edge 36 of the second conductive surface 32 may be entirely coupled to the ground plane 18 along its length, or alternatively, only a portion of edge 36 may be operatively coupled thereto. An alternate means for shorting the second conductive surface 32 to the ground plane 18 may be a foot or pad element (not shown). In this regard, the foot or pad element of the third conductive surface 32 may facilitate coupling to the ground plane 18 through known surface mounting techniques. First conductive surface 30 is also electrically coupled to a substantially perpendicular third conducting surface 38. Third conductive section 38 is approximately 'T'-shaped when viewed from its side and includes a lower perpendicular coupling plate 40.

Referring to FIGS. 1 and 2, the conductor element 14 at lower coupling plate 40 defines one side or plate of a two-plate capacitor, the other "side"being the ground plane element 18. Coupling plate 40 is spaced away (here, approximately 0.010 inch) from the ground plane 18 by a dielectric element 44 so as to form a capacitor having a capacitance on the order of 4 picofarads. The area of the coupling plate 40 is approximately 0.08 inches square. The dielectric element 44 may be a fiberglass or composite product with a relative dielectric constant on the order of 4.5, and a thickness of 0.010 inches. The dielectric material 44 may have a dielectric constant other than 4.5, and the size of capacitor plate 38 may vary from the dimensions shown in FIG. 1. Preferably, one value of capacitance is approximately 4 picofarads.

The ground plane 18 of the wireless communication device 10 is approximately 1.6 inches wide and extends 0.25 inches above the second conductive surface 32. The ground plane 18 has an overall length of 5.5 inches in a preferred configuration, or approximately ¼ of a wavelength within the range of operational wavelengths. For the illustrated embodiment, minimum dimensions for the width and height dimensions of portions of ground plane 18 are 1.25 and 0 inches respectively. Alternative dimensions may result in different electrical characteristics such as frequency range, gain, and front to back ratio than the preferred dimensions.

The antenna 12 may be fed with a 50 ohm coaxial line 48, as shown in FIG. 2. The outer shield 50 is electrically connected to the ground plane 18, and its center conductor 52 traverses through an aperture in the PWB 16 and is connected to the first conducting surface 30 to define a feedpoint 54. Alternatively, the coax 48 may be disposed within the interior region 20 of the radiating conductor element 14. The feedpoint 54 is preferably defined at a point along the longitudinal centerline of the first conducting surface 30 and nearer to the upper second conducting surface 32 of the radiating conductor element 14. Alternatively, the feedpoint may be disposed at a point along a transverse line 78, illustrated in FIG. 1. The feedpoint 54 may also be located off the centerline, such as along a diagonal of the first conducting surface 30 to achieve circular polarization. The coax cable 48 may be eliminated if the PWB (printed wiring board 17) of the wireless transceiver 10 provides a 50 ohm RF output/input pad/port to which signal conductor is coupled. Polarization of the antenna 12 is along the longitudinal dimension of the ground plane 18, as shown in FIG. 2. The preferred feedpoint 54 results in linear polarization.

As further illustrated in FIG. 2, a matching component 80 may be utilized to enhance the bandwidth of the antenna assembly 12. The matching device 80 may be a capacitor element series-coupled to the feed conductor 54. Alternative matching components or devices 80 may be appreciated by those skilled in the relevant arts.

Figure 3:
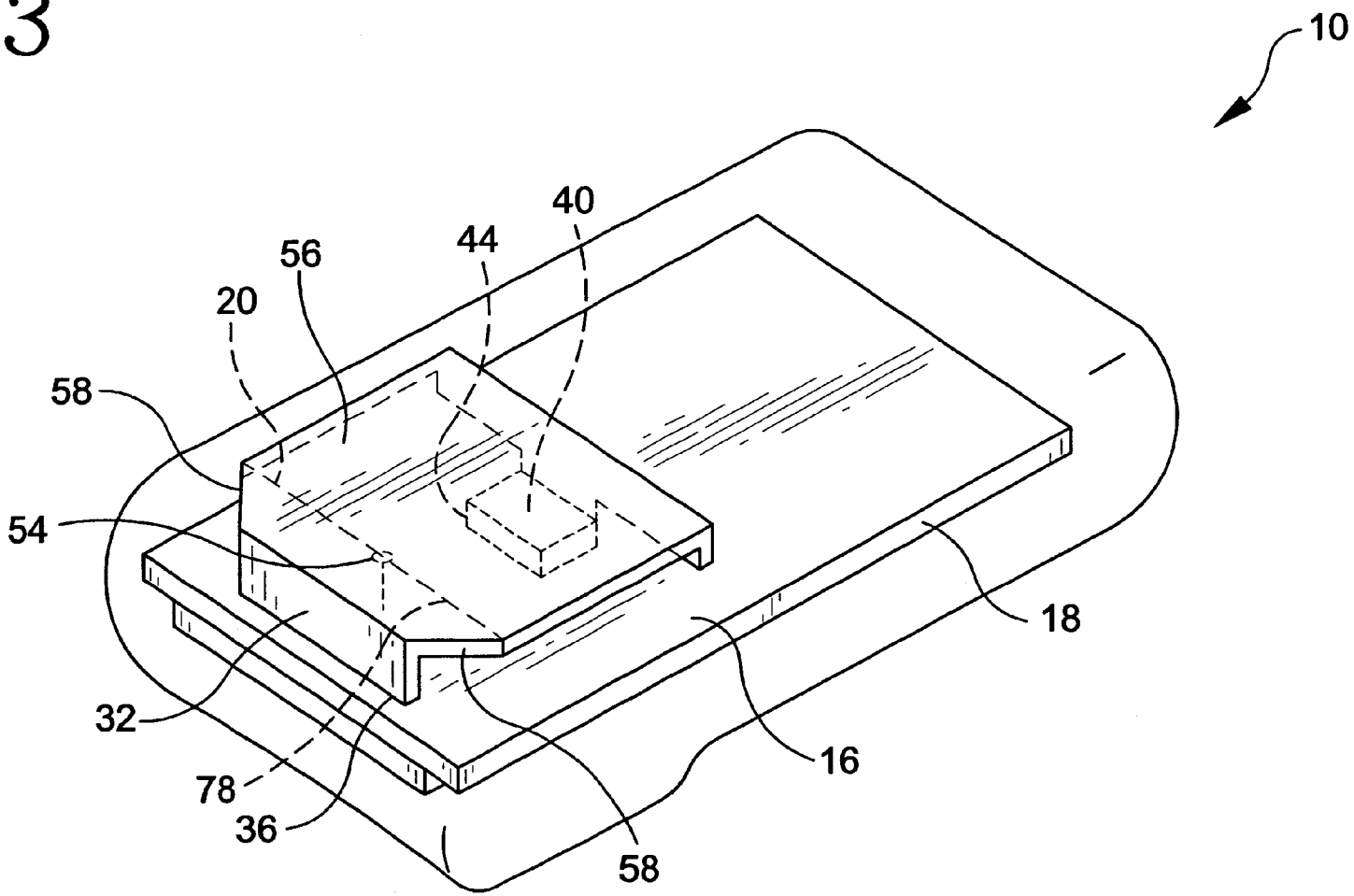
FIG. 3 illustrates a perspective view of a second embodiment of an antenna assembly according to the present invention.

FIG. 3 illustrates an alternate configuration for the first conducting surface 56 of the radiating conductor 14. As compared to the first conducting surface 30 of FIGS. 1 and 2, the first conducting surface 56 of FIG. 3 provides angular notches or corners 58 at its upper edge. The removed structure 58 permits the antenna assembly 12 to conform with and be received within a curved or otherwise non-rectangular transceiver 10 housing.

Figure 4:
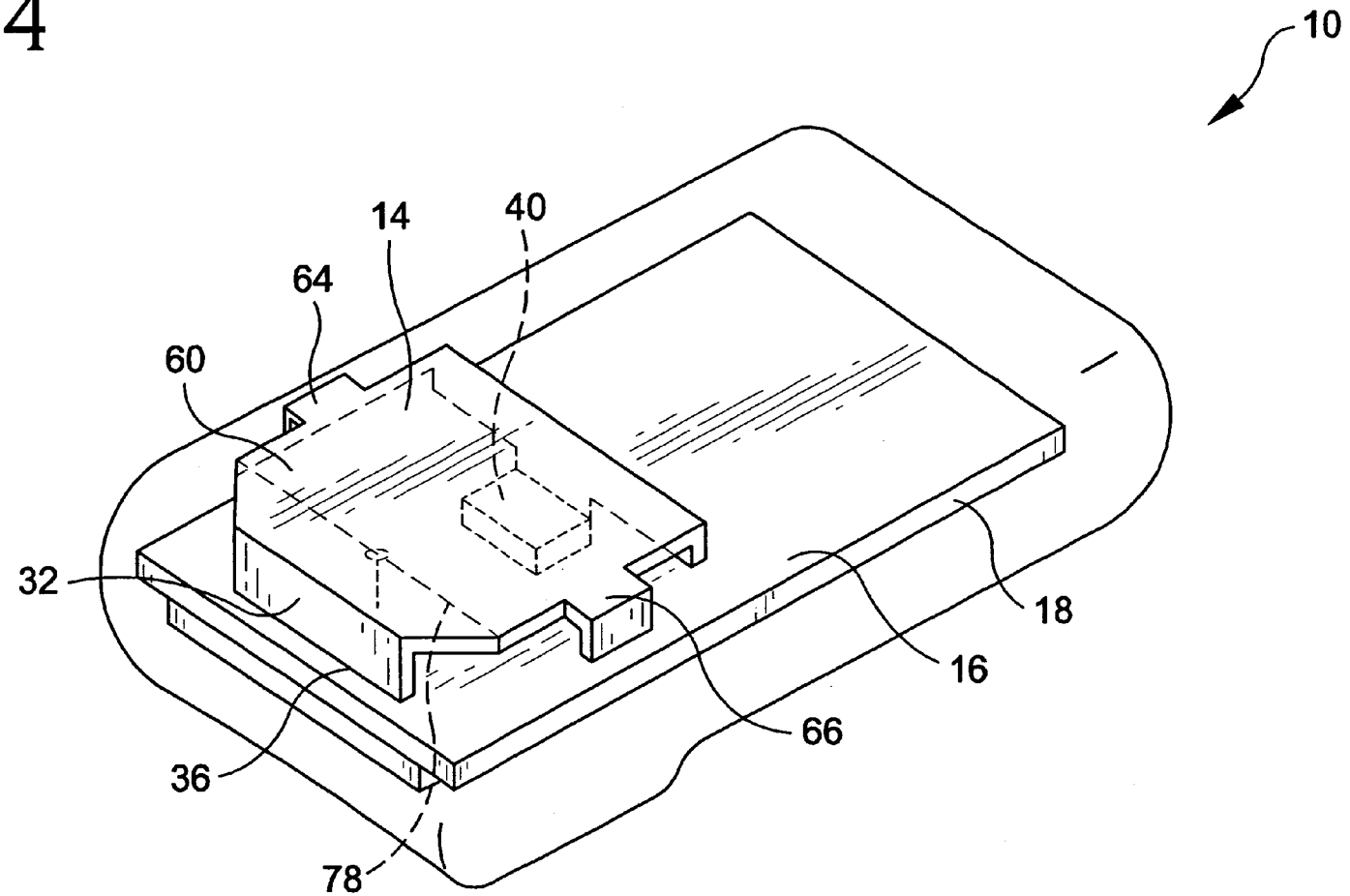
FIG. 4 illustrates a perspective view of a third embodiment of an antenna assembly according to the present invention.

FIG. 4 illustrates yet another embodiment of the radiating conductor element 14. This embodiment of the conductor element may be utilized to achieve improved VSWR bandwidth. The first surface conductor element 60 of FIG. 4 includes a pair of laterally disposed wing elements 64, 66 downwardly depending from the first conductive surface 60 toward the ground plane element 18.

The preferred antenna assembly 12 shown herein is for operation over the 824–894 MHz frequency range. Dimensions may be scaled directly, for bands such as 880–960 MHz (cellphone 902–928 MHz (cordless phone)), 1575 MHz (GPS), 1710–1870 (cellphone), 1850–1990 MHz (cellphone), 2450–2500 MHz, (LAN, cordless phone).

Figure 5:
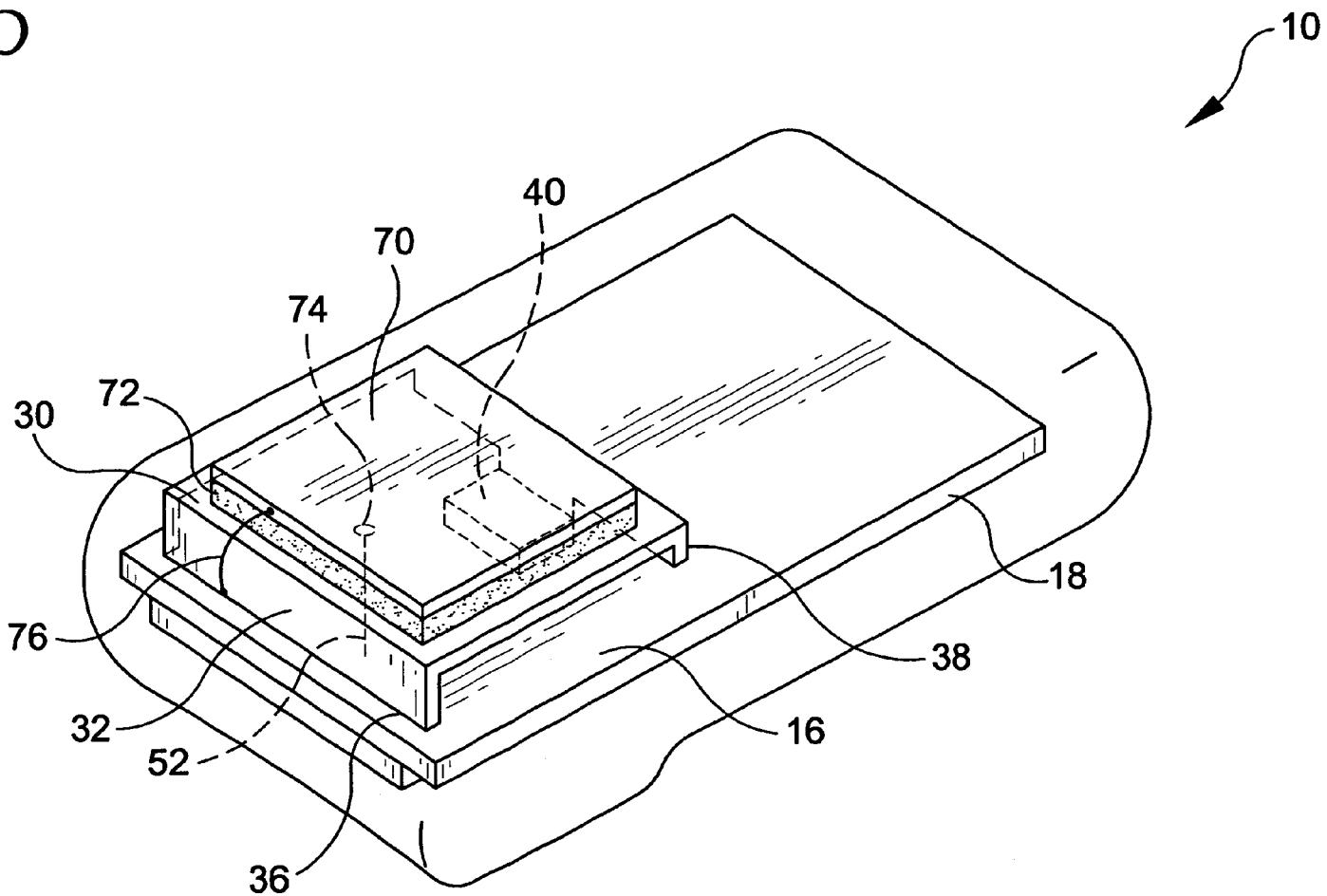
FIG. 5 illustrates a perspective view of a fourth embodiment of an antenna assembly according to the present invention.

FIG. 5 illustrates a multi-frequency embodiment of the present invention. Operation over a second, higher frequency band may be achieved by adding another radiating conductive surface 70 parallel to and above the first radiating surface 30 (in the direction away from the ground plane 18). A dielectric substrate element 72 may be disposed between the first and second radiating elements 30, 70. The dielectric substrate element 72 may have a dielectric constant selected within the range of 1 to 80, with one embodiment having values in the range of 1–10. The coax center conductor 52 is extended in non-contacting manner through the first radiating element 30 and coupled to the second radiating element 70 at a second feedpoint 74 as shown. A grounding conductor 76 may be coupled between the second radiating element 70 and the ground plane element 18, such as at the upper edge of the second radiating element 32. A spacing between the second conducting surface 70 and the first conducting surface 30 may be in the range 0.002–0.12 of a wavelength within the higher frequency band. The dielectric element 72 may have a relative dielectric constant between 0–10. The dimensions of the second radiating element 70 are approximately 0.12 of a wavelength square at the higher frequency band for relative dielectric constant= 0, and proportionally smaller for increasing dielectric constant. An additional one or more radiating conducting surfaces may also be similarly utilized to cover a third, or more, yet higher frequency band(s).

Figure 6:
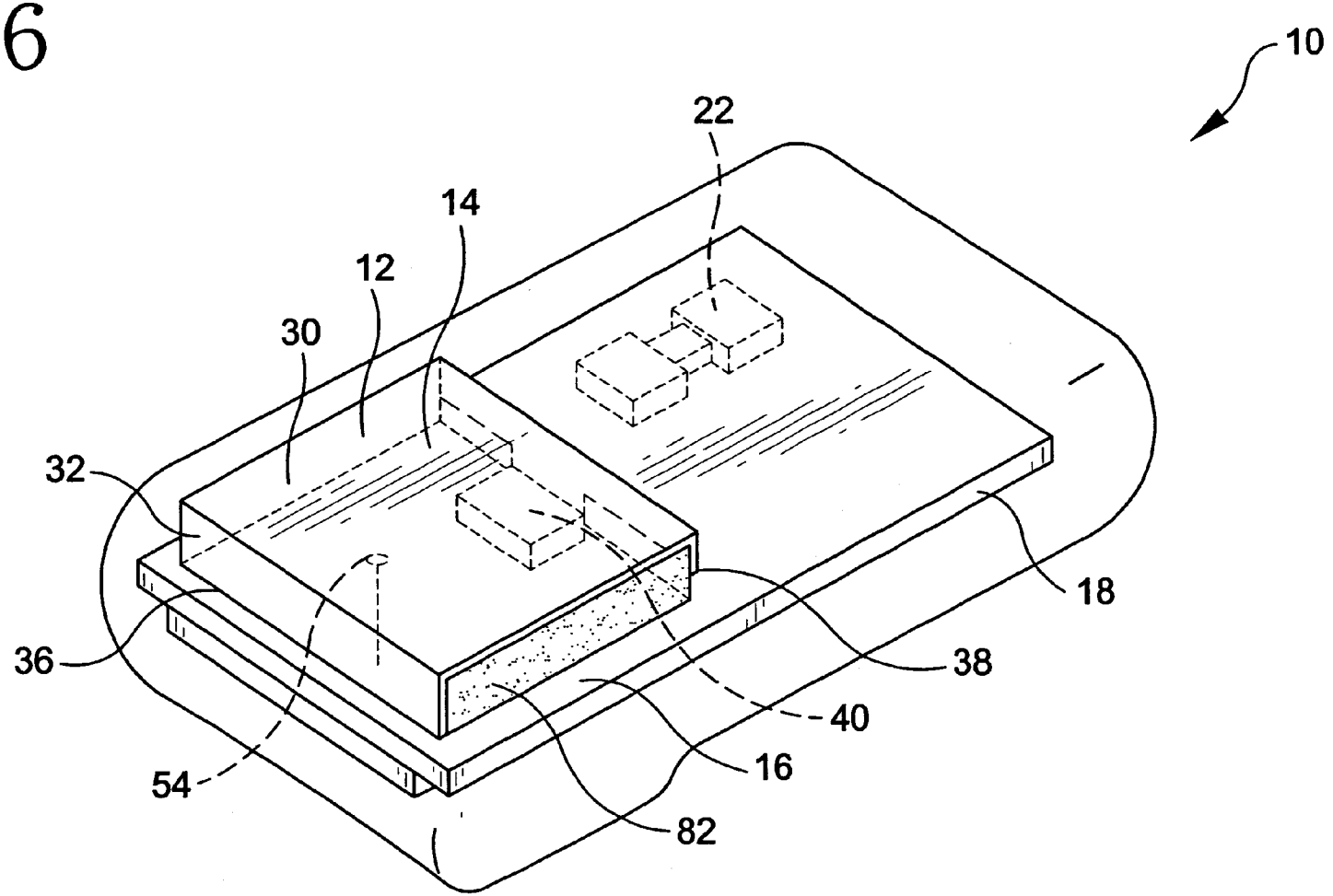
FIG. 6 illustrates a perspective view of another embodiment of an antenna assembly according to the present invention.

FIG. 6 illustrates another embodiment of an antenna assembly 12 according to the present invention. A dielectric support element 82 may be disposed between the radiating conductor element 14 and the ground plane 18. The dielectric support element 82 may be a block of dielectric material having a suitably low loss tangent. The antenna assembly 12 of FIG. 6 includes a radiating conductor element 14 disposed upon the dielectric support element 82. In various embodiments, the dielectric support element 82 may be a molded plastic part having a conducting film or layer selectively disposed thereupon to define the radiating element 14. Selective etching and other known processes may be utilized to define the radiating element 14 upon the plated dielectric support element 82. Additionally, stamped or processed metal parts may be attached or disposed within the molded plastic support element 82 to implement the radiating element 14.

Although particular embodiments of the invention have been illustrated in the accompanying Drawings and described in the foregoing Detailed Description, it will be understood that the invention is not limited only to the embodiments disclosed, but is intended to embrace any alternatives, equivalents, or modifications falling within the scope of the invention as defined by the following claims.

We claim:

1. An antenna assembly for a wireless communication device for receiving and and transmitting a communication signal, said wireless communication device having a ground plane element disposed upon a dielectric element, said wireless communication device further having a feedline conductor, said antenna assembly comprising:

a first radiating conductor element defining a pair of opposed ends each disposed proximate the ground plane element and an intermediate extending portion disposed away from the ground plane element to define an interior region, said first radiating conductor element being generally c-shaped, and said interior region receiving a plurality of device electronics disposed upon the dielectric board element;

a first operative coupling between one of the pair of opposed ends of the first radiating conductor element and the ground plane element;

a second operative coupling between the other end of the first radiating conductor element and the ground plane element, said second operative coupling being a capacitive coupling; and a feedpoint disposed within the extending portion of the radiating conductor element, said feedpoint operatively coupled to the feedline conductor disposed within the interior region.

2. An antenna assembly according to claim 1, wherein the first radiating conductor element includes a plurality of surfaces, including at least a first conducting surface, a second conducting surface, and a third conducting surface.

3. An antenna assembly of claim 2, wherein the plurality of conducting surfaces are each substantially planar.

4. An antenna assembly of claim 3, wherein the first conducting surface is substantially perpendicular to both the second conducting surface and the third conducting surface.

5. An antenna assembly of claim 4, wherein the third conducting surface is coupled to a plate section, said plate section defining a portion of the capacitive coupling of the radiating conductive element.

6. An antenna assembly of claim 4, wherein the feedpoint is aligned along a longitudinal centerline of the first conducting surface of the radiating conductor element.

7. An antenna assembly of claim 1, further comprising:

a second radiating conductor element disposed away from the first radiating conductor element, said second radiating conductor element further being operatively coupled to the feedline conductor and being coupled to the ground plane element via a ground conductor.

8. An antenna assembly of claim 7, further comprising:

a dielectric substrate element disposed between the first radiating conductor element and the second radiating conductor element.

9. An antenna assembly of claim 1, further comprising:

an additional radiating conductor element disposed a predetermined different distance away from the first radiating conductor element and being couple both to the feedline conductor and to the ground plane element via a ground conductor.

10. An antenna assembly for a wireless communication device for receiving and transmitting a communication signal, said antenna assembly comprising:

a dielectric board element;

a ground plane element disposed upon the dielectric board element within the wireless communication device;

a plurality of device electronics disposed upon the dielectric board element;

a feedline conductor defining a signal transmission output; and a first radiating conductor element having a pair of opposed ends disposed proximate the ground plane element and an intermediate extending portion disposed away from the ground plane element to define an interior region, said first radiating conductor element being generally c-shaped, and said interior region receiving a least some of the plurality of device electronics disposed upon the dielectric board element, one of the pair of opposed ends being operatively coupled to the ground plane element, said intermediate extending portion operatively coupled to the feedline conductor at a feedpoint.

11. An antenna assembly according to claim 10, wherein the first radiating conductor element includes a plurality of surfaces, including at least a first conducting surface, a second conducting surface, and a third conducting surface.

12. An antenna assembly of claim 11, wherein the plurality of conducting surfaces are each substantially planar.

13. An antenna assembly of claim 12, wherein the first conducting surface is substantially perpendicular to both the second conducting surface and the third conducting surface.

14. An antenna assembly of claim 13, wherein the third conducting surface is coupled to a plate section, said plate section defining a portion of the capacitive coupling of the first radiating conductive element.

15. An antenna assembly of claim 13, wherein the feedpoint is aligned along a longitudinal centerline of the first radiating conductor element.

16. An antenna assembly of claim 10, wherein the ground plane element is defined upon a printed wiring board of the wireless communication device.

17. An antenna assembly of claim 10, further comprising:

a second radiating conductor element disposed away from the first radiating conductor element, said second radiating conductor element further being operatively coupled to the feedline conductor and being coupled to the ground plane element via a ground conductor.

18. An antenna assembly of claim 17, further comprising:

a dielectric substrate element disposed between the first radiating conductor element and the second radiating conductor element.

19. An antenna assembly of claim 10, further comprising:

an additional radiating conductor element disposed a predetermined different distance away from the first radiating conductor element and being coupled both to the feedline conductor and to the ground plane element via a ground conductor.

20. An antenna assembly for a wireless communication device for receiving and transmitting a communication signal, said wireless communication device having a ground plane element disposed within a dielectric board element, said wireless communication device further having a feedline conductor, said antenna assembly comprising:

a substantially C-shaped radiating conductor element having a pair of opposed ends disposed proximate the ground plane element and an intermediate extending portion disposed away from the ground plane element to define an interior region, said interior region receiving a plurality of device electronics disposed upon the dielectric board element said first end operatively coupled to the ground plane element, said second end capacitively coupled to the ground plane element, said intermediate extending portion operatively coupled to the feedline conductor at a feedpoint between the first end and the second end and within the interior region.

21. An antenna assembly of claim 20, further comprising:

a second radiating conductor element disposed away from the first radiating conductor element, said second radiating conductor element being operatively coupled to the feedline conductor and being coupled to the ground plane element via a ground conductor.

22. An antenna assembly of claim 21, further comprising:

a dielectric substrate element disposed between the second band radiating conductor element and the first radiating conductor element.

23. An antenna assembly for a wireless communication device for receiving and transmitting a communication signal, said wireless communication device having a ground plane element, said wireless communication device further having a feedline conductor, said antenna assembly comprising:

a dielectric board element supporting the ground plane element;

a first radiating conductor element being at least partially disposed upon the dielectric board element, said first radiating conductor element having a plurality of surfaces together defining a pair of opposed ends and an intermediate portion away from the ground plane element, said first radiating conductor element defining an interior region between the plurality of surfaces and the dielectric board element, said radiating conductor element being coupled to the feedline conductor at a feedpoint disposed within the interior region, one of the pair of opposed ends being operatively coupled to the ground plane element, and the other of the pair of opposed ends being capacitively coupled to the ground plane element, said interior region receiving a plurality of device electronics disposed upon the dielectric board element.

24. An antenna assembly of claim 23, further comprising:

a second radiating conductor element disposed away from the first radiating conductor element, said second radiating conductor element being operatively coupled to the feedline conductor and being coupled to the ground plane element via a ground conductor.

25. An antenna assembly of claim 24, further comprising:

a dielectric substrate element disposed between the second radiating conductor element and the first radiating conductor element.

26. An antenna assembly of claim 25, wherein a dielectric constant of the dielectric substrate element is between 1 and 80.

27. An antenna assembly of claim 26, wherein the dielectric constant is between 1 and 10.

28. An antenna assembly of claim 23, further comprising:

an additional radiating conductor element disposed a predetermined different distance away from the first radiating conductor element and being coupled both to the feedline conductor and to the ground plane element via a ground conductor.

* * * * *